United States Patent [19]

Staup

[11] 4,140,164

[45] Feb. 20, 1979

[54] CRIME PREVENTION POCKETBOOK

[75] Inventor: Frederick Staup, Birmingham, Mich.

[73] Assignee: Mary Straup, Sarasota, Fla.

[21] Appl. No.: 679,796

[22] Filed: Apr. 23, 1976

[51] Int. Cl.[2] ..... A45C 13/18

[52] U.S. Cl. ..... 150/28 R; 150/47

[58] Field of Search ..... 150/28 R, 47, 28 A, 150/33, 34

[56] References Cited

U.S. PATENT DOCUMENTS

| | | | |
|---|---|---|---|
| 2,609,854 | 9/1952 | Rosen | 150/28 A |
| 2,845,974 | 8/1958 | Arden | 150/28 R |
| 3,881,534 | 5/1975 | Gist | 150/28 R |

FOREIGN PATENT DOCUMENTS

| | | | |
|---|---|---|---|
| 1079577 | 12/1954 | France | 150/28 R |
| 1215200 | 4/1960 | France | 150/28 R |
| 598122 | 9/1959 | Italy | 150/28 R |

*Primary Examiner*—Ro E. Hart

[57] ABSTRACT

An item of protection for all persons carrying a pocketbook, purse, or bag, designed for safety against purse snatchers, thieves, and petty larceny. A pocketbook constructed with a break-away feature throughout the seams of the pocketbook constructed so when a victim is attacked by a purse snatcher or thief, the pocketbook begins to separate at the seams and continues around the perimeter of the pocketbook until the thief lets go or the victim lets go of the pocketbook. The contents of the pocketbook spill to the ground in the open compartment, and stay in the pockets of the enclosed zipper compartments after the purse snatcher's act is completed. The pocketbook is then resealed by picking up the parts and placing them together. The contents are then placed back into the pocketbook and the intended victim goes about her way with no loss of personal possession nor does she receive serious injury from over-the-shoulder models.

8 Claims, 3 Drawing Figures

CRIME PREVENTION POCKETBOOK

FIELD OF THE INVENTION

This invention deals with a pocketbook designed and constructed to separate and completely come apart at the seams when pulled or grabbed by a purse snatcher or thief. Conventional pocketbooks of standard construction offer no real safety features against purse snatchers or thieves, and are not constructed to separate or come apart at the seams when a person is attacked by a thief.

DESCRIPTION OF PRIOR ART

For years there has been a major problem of how to handicap purse snatchers who use techniques of surprise attacks on their intended victims. Pocketbooks today are made for fashion and style only; incorporating no safety features against potential thieves and purse snatchers. Hundreds of victims daily across the nation are either injured, or lose their personal possessions by purse snatchers who steal their pocketbook when passing by in a moving automobile, motorcycle, or bicycle, or by running up from behind the victim and wrenching the pocketbook from the victim by grabbing the strap or the bag itself. The crime prevention pocketbook was designed to eliminate this easy method of stealing and thus reducing the chances of serious injury when the victim is knocked to the ground if the shoulder strap gets caught in the victim's arm.

SUMMARY OF THE INVENTION

The primary object of the present invention is to provide a pocketbook with a built-in protective feature against purse snatchers, thieves, etc., but styled for fashion as well as safety. A further object of this invention is to adequately protect a victim against serious injury which follows after a thief grabs a pocketbook from the intended victim, from his position in a passing automobile, or on a motorcycle. Another important object of this invention is if a purse snatcher grabs the shoulder strap, or the bag portion of the pocketbook, he will not escape with any personal possessions, unless he stands around and picks up the articles off the ground. The items that rest in the enclosed zipper compartments remain there, and do not scatter. All these features will become subsequently apparent in the details of construction to follow in the description of the accompanying drawings, together with a written description of the claims.

DESCRIPTION OF THE PREFERRED EMBODIMENT

Figure 1:
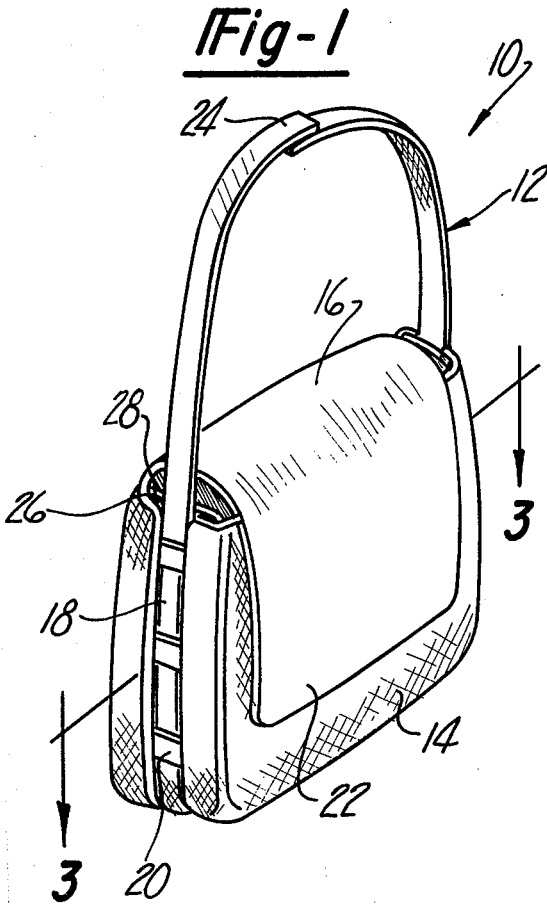
FIG. 1 is a perspective view of the crime prevention pocketbook (shoulder model) showing the invention in ready-to-use travel form.
Figure 2:
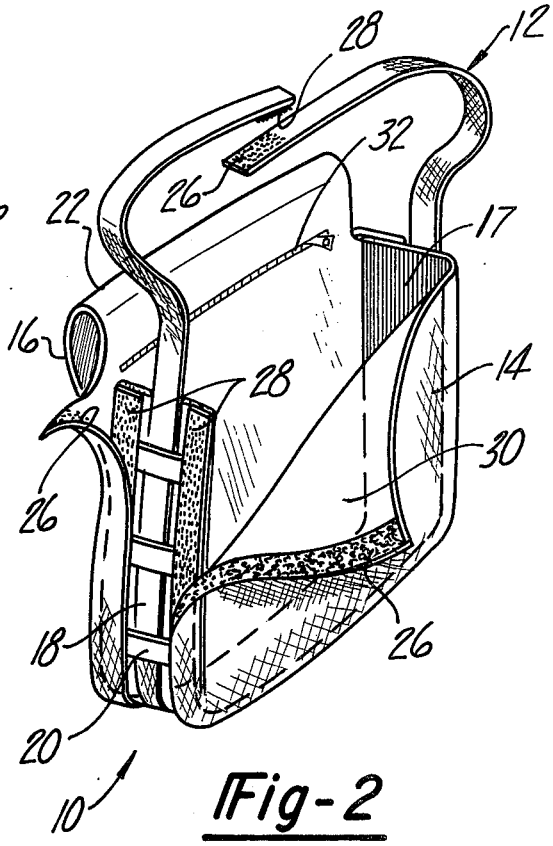
FIG. 2 is a separation view of the break-away feature (shoulder model) showing the invention in view of 25% separation, showing how the pocketbook is designed to come apart throughout the perimeter of the model.
Figure 3:
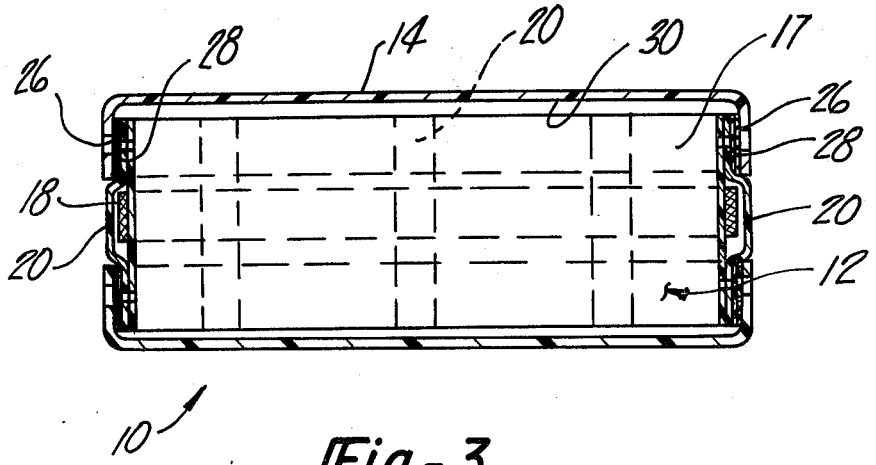
FIG. 3 is a sectional view illustrating the functioning parts of the break-away principle of the connecting harness assembly.

Referring now specifically to the drawings, the crime prevention pocketbook design of the present invention is designated by reference numeral 10 which shows the complete assembly shown in FIG. 1. Continuing further with FIG. 1, illustrates the front side panel 14 and the back side panel 16 adjoined to the closing flap 22 which extends over the front side panel 14. Continuing on with FIG. 1 to the connecting harness panel 18 extending around the perimeter of the pocketbook joined together with two parallel rows of velcro hook 26 and loop 28 from end to end with front side panel 14, and back side panel 16. Within the connecting harness panel is the strap 12 that extends through the belt loops 20 continuing around the perimeter of the pocketbook, ending at the velcro connecting points 24, where both ends of the strap join together. Continuing on to FIG. 2 shows the pocketbook in 25% separation view, beginning with the velcro connecting points 26 and 28 separating from both side panels 14 and 16 around the perimeter of the pocketbook from the connecting harness assembly 17. Going further with FIG. 2 to the inside partial view of the closing flap 22 shows the enclosed zipper compartment 32 in view against the back side panel 16. Both side panels are lined as shown in 30 of FIG. 2. Continuing on to FIG. 3 shows a cross sectional view of the connecting harness assembly 17, showing all the parts covered in FIGS. 1 and 2 in one deminsion. The specific manner of making and assembling the parts, the order of construction and sewing of the parts assembly, in any sewing operation is immaterial to the invention shown and described in the drawings. Since any manufacturing options of this invention will fall into the scope of this invention shown in the drawings just outlined and explained.

What I claim as new in support of this application is as follows:

1. A pocketbook assembly of the type primarily designed to prevent theft and including a yieldable, break away construction, said pocketbook assembly comprising: a front side panel and a back side panel each structured and configured to collectively define the exterior of said pocketbook assembly, a connecting harness assembly disposed in interconnecting relation to both said front side panel and said back side panel, both said front and back side panels including a connecting harness panel disposed along a predetermined peripheral portion of each, fastening means mounted on said connecting harness assembly and each of said connecting harness panels of said front and back side panels, said fastening means comprises a hook and loop type fastener assembly, said fastening means structured for removable attachment between said connecting harness assembly and said front and back side panels, a holding strap attached to said connecting harness assembly, whereby excess force exerted either on said front and back side panels cause a separation of one from the other and prevents injury to the carrier of said pocketbook assembly.

2. A pocketbook assembly as in claim 1 wherein said holding strap comprises strap connecting means mounted on connectable portions of said holding strap and structured for removable attachment to one another, whereby excess force exerted thereon will cause separation of said connectable portions of said strap.

3. A pocketbook assembly as in claim 2 wherein said holding strap comprises at least two of said connectable portions disposed in removable attachment to one another and collectively being of a longitudinal dimension sufficient to define a shoulder strap for mounting said pocketbook assembly on the shoulder of the bearer.

4. A pocketbook assembly as in claim 1 wherein said strap connecting means comprises hook and loop fastening assembly removably interconnected to one another.

5. A pocketbook assembly as in claim 1 further comprising a closing flap integrally attached to said back side panels and disposed and configured to extend in overlapping relation to said front side panel; said pocketbook assembly further comprising compartments means formed in one of said back and front side panels and disposed to hold articles therein in separated relation to the remainder of the interior of said pocketbook assembly.

6. A pocketbook assembly as in claim 5 wherein said compartment means includes a zipper closure disposed to separate it from the remainder of the interior of said pocketbook assembly.

7. A pocketbook assembly as in claim 1 wherein said front and back side panels are interconnected to said connecting harness assembly so as to define an article carrying interior portion, each of said front and back side panels removably attached to said connecting harness assembly so as to expose said interior portion when excess force is exerted on said pocketbook assembly.

8. A pocketbook assembly as in claim 1 wherein said connecting harness assembly further comprises a plurality of loop elements mounted thereon and disposed in at least partially surrounding relation to said holding strap, said plurality of loop elements being disposed in spaced apart relation to one another along at least a portion of the length of said holding strap.

* * * * *